US007247029B2

(12) United States Patent
Chen

(10) Patent No.: US 7,247,029 B2
(45) Date of Patent: Jul. 24, 2007

(54) ELECTRICAL CONNECTOR WITH IMPROVED TERMINAL

(75) Inventor: Küna Hüaa Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/291,368

(22) Filed: Dec. 1, 2005

(65) Prior Publication Data

US 2006/0116008 A1 Jun. 1, 2006

(30) Foreign Application Priority Data

Dec. 1, 2004 (CN) ..... 2004 2 0109405

(51) Int. Cl.
*H01R 12/00* (2006.01)

(52) U.S. Cl. ..... 439/66; 439/74

(58) Field of Classification Search ..... 439/74, 439/66

See application file for complete search history.

(56) References Cited

U.S. PATENT DOCUMENTS

| | | | | |
|---|---|---|---|---|
| 5,240,430 | A * | 8/1993 | Soes | 439/260 |
| 5,626,500 | A * | 5/1997 | Yoshimura | 439/862 |
| 5,975,916 | A * | 11/1999 | Okura | 439/74 |
| 6,623,308 | B2 * | 9/2003 | Ono | 439/680 |
| 6,923,659 | B2 * | 8/2005 | Zhang et al. | 439/74 |
| 2004/0157478 | A1 * | 8/2004 | Midorikawa et al. | 439/74 |

* cited by examiner

*Primary Examiner*—Truc Nguyen
(74) *Attorney, Agent, or Firm*—Wei Te Chung

(57) ABSTRACT

An electrical connector for connecting a pair of separated PCBs, includes a female connector (1) and a male connector (2) respectively connectable to the two PCBs. The female connector includes a first insulator (10) and a number of female terminals (11). Each female terminal has a resilient contact section (114) provided with three compressible portions (1141) with a contacting end (115) formed thereon. The male connector includes a second insulator (20) and a number of male terminals (21). Each male terminal is formed with a fixing portion (213) and a connection portion (214) capable of contacting with the contacting end.

20 Claims, 8 Drawing Sheets

ELECTRICAL CONNECTOR WITH IMPROVED TERMINAL

BACKGROUND OF THE INVENTION

1. Field of the Invention

The present invention relates to an electrical connector having a male connector and a female connector capable of mating with each other and connectable to a pair of separated PCBs respectively for electrically connection between the PCBs.

2. Description of Related Art

Generally, an electrical connector connectable to a pair of separated PCBs for electrically connecting between the PCBs is required in personal computers, mobile phones or the likes.

A conventional lower profile electrical connector assembly described in U.S. Pat. No. 5,975,916 comprises a socket and a detachable plug. The socket and the plug respectively has a plurality of arrayed first terminals, second terminals mounted thereon. Each second terminal comprises an U-shaped portion having an upwardly extending second spring contact, a second lead extending outwardly from a bottom of the plug for electrically connecting with a PCB and a connecting portion connecting the second spring contact and the second lead. Each first terminal comprises a first spring contact, a generally S-shaped section and a first lead extending outwardly from a bottom of the socket for electrically connecting with another PCB. The generally S-shaped section has an inverted U-shaped portion fixed to the socket and an upright U-shaped portion extending from an end of the inverted U-shaped portion. The first spring contact is formed at a free end of the upright U-shaped portion for contacting with the second spring contact of the second terminal. When the plug is inserted into the socket, the second spring contact yields to the first spring contact and is caused to resiliently flex inwardly for being resisted against by the first spring contact. The first and second terminals are thus kept electrically connected due to the engagement between the first and the second spring contact.

The S-shaped section has a fixed inverted U-shaped portion and an upright U-shaped portion capable of resiliently flexing. When the second spring contact is resisting against the first spring contact, the unfixed upright U-shaped portion could not have a sufficient resilient deformation and thus is easy to have a distort. That may result in unreliable engagement between the first and second spring contact.

Another conventional connector described in U.S. Pat. No. 6,623,308 comprises a socket body and a detachable plug body provided with two pairs of flanges at a pair of opposite sides. The socket body and the plug body respectively has a plurality of arrayed first terminals, second terminals mounted thereon. Each first terminal comprises a contacting portion mounted along an outer surface of the plug body and a soldering portion extending from an end of the contacting portion for soldering onto a PCB. A slot is defined between each pair of flanges for insertion of the mounting portions to thereby make the first terminals fixed to the plug body.

As is described above, the first terminals are fixed to the plug body by making the soldering portions thereof inserted into slots. Therefore, the first terminals could not be fastened in the plug body firmly and thus is easy to be divorced from the plug body when the plug body is inserted into or pulled out from the socket body for many times.

Another conventional electrical connector is described in U.S. Patent Application Publication No. 2004/0157478. The electrical connector to which a mating connector is fitted, comprises an insulator and a plurality of first terminals arranged in a pair of opposed walls of the insulator. Each first terminal has a contact portion formed at an end thereof, an S-shaped bent portion extending from the contact portion, a connecting portion fixed to the insulator and a tail formed at another end for soldering onto a PCB. When the first terminals are contacting with a plurality of second terminals assembled to the mating connector, the unfixed S-shaped bent portion would have a resilient deformation.

However, the S-shaped bent portions could not supply sufficient resilient force or adequate intensity to the first terminals when the structure is used for certain a long time. That may result in unreliable engagement between the first and second terminals.

Hence, an improved electrical connector is required to overcome the above-mentioned disadvantages of the related art.

SUMMARY OF THE INVENTION

A primary object of the present invention is to provide an electrical connector having a plurality of improved terminals, which are compressible and have more flexibility and adequate intensity.

To achieve the aforementioned objects, an electrical connector for connecting a pair of separated PCBs, comprising: a female connector and a male connector respectively connectable to the two PCBs. The female connector comprises a first insulator and a plurality of female terminals. Each female terminal has a resilient contact section provided with three compressible portions with a contacting end formed thereon. The male connector comprises a second insulator and a plurality of male terminals. Each male terminal is formed with a fixing portion fixed to the second insulator and a connection portion capable of contacting with the contacting end.

Other objects, advantages and novel features of the invention will become more apparent from the following detailed description of a preferred embodiment when taken in conjunction with the accompanying drawings.

DETAILED DESCRIPTION OF THE INVENTION

Figure 1:
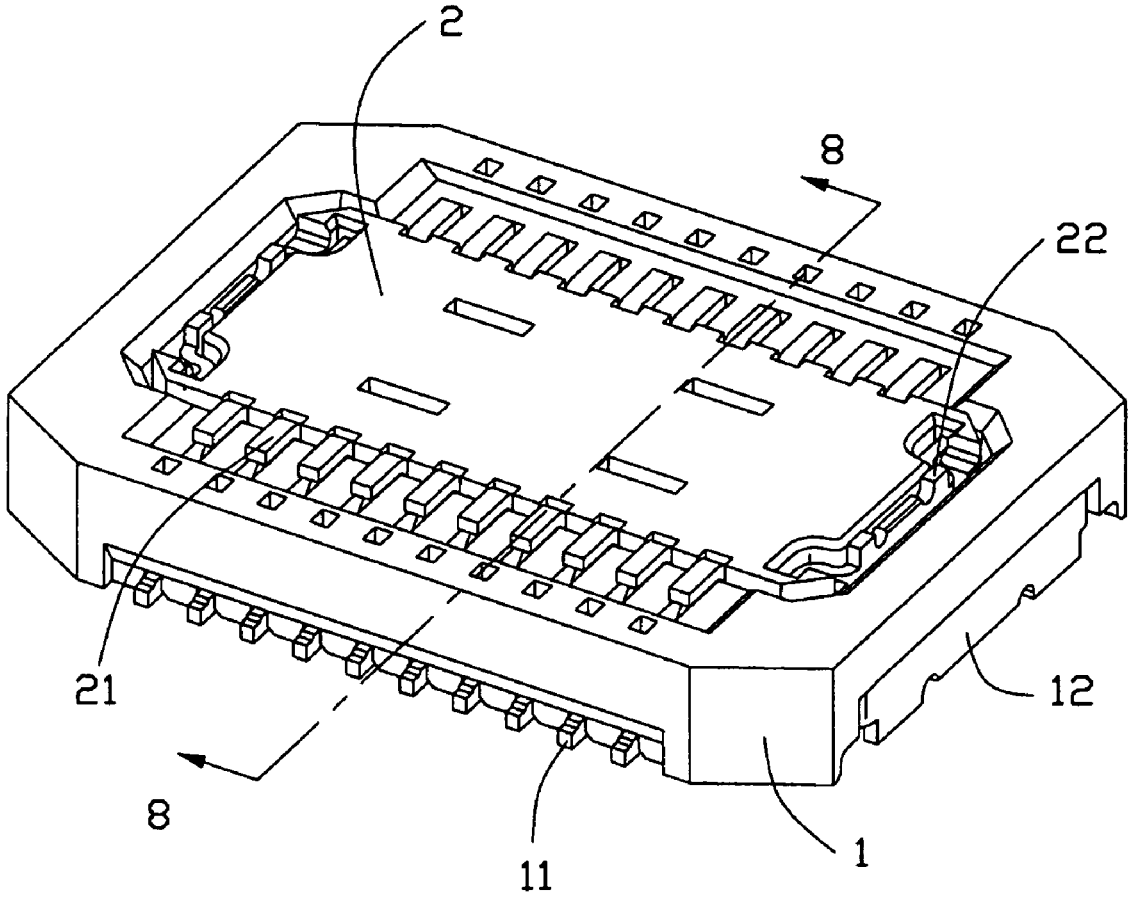
FIG. 1 is an assembled perspective view of an electrical connector in accordance with the present invention.
Figure 2:
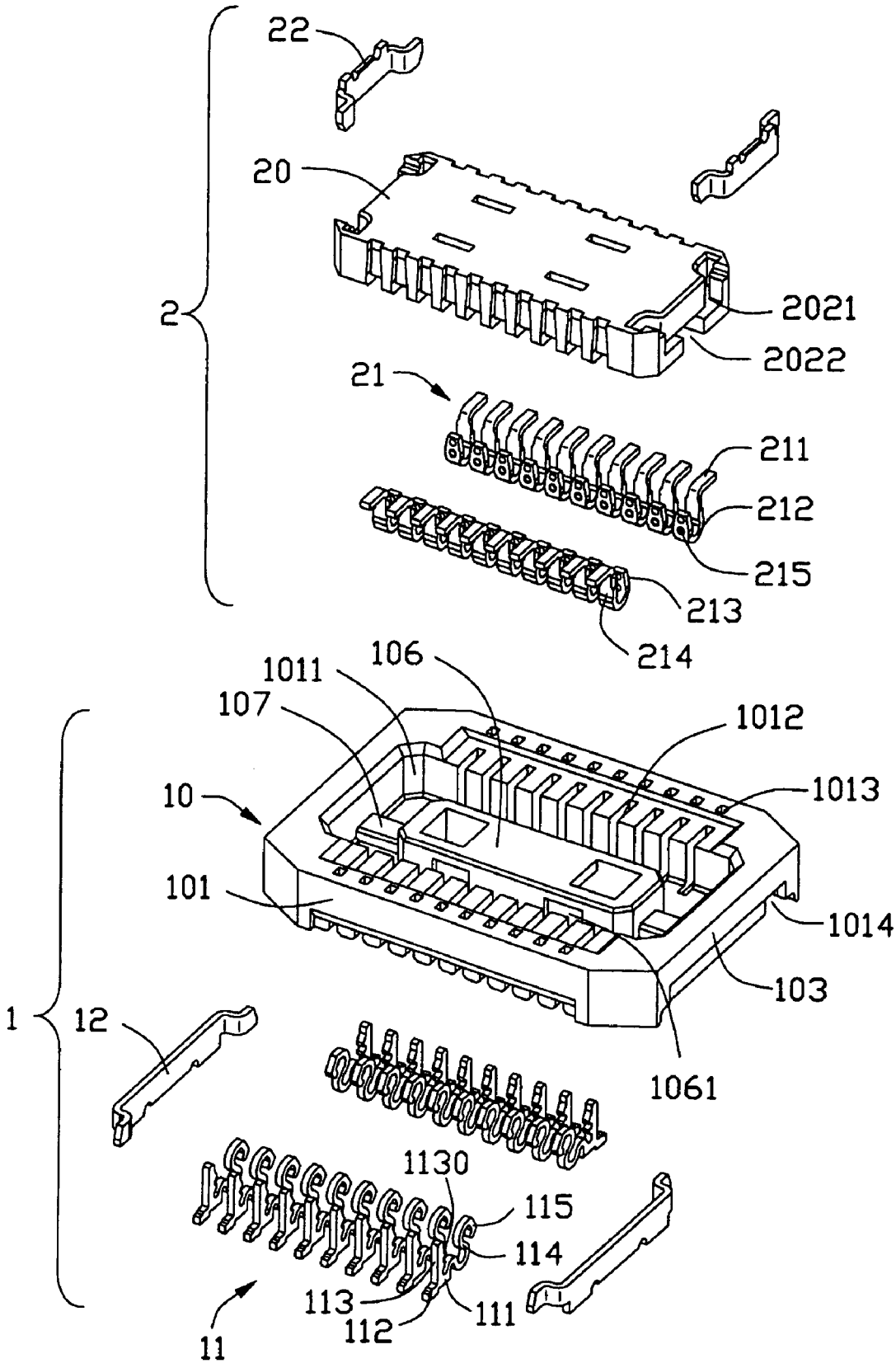
FIG. 2 is an exploded view of the electrical connector as shown in FIG. 1.

Reference will now be made to the drawing figures to describe the present invention in detail. Referring to FIG. 2, an electrical connector in accordance with the preferred embodiment of the present invention comprises a female connector 1 and a detachable male connector 2 respectively connectable to a first PCB (not shown) and a second PCB (not shown) for electrically connection between the PCBs.

The female connector 1 comprises a first insulator 10, a plurality of female terminals 11 assembled to the insulator 10 and a pair of first mounting portions 12 mounted on the insulator 10.

Figure 3:
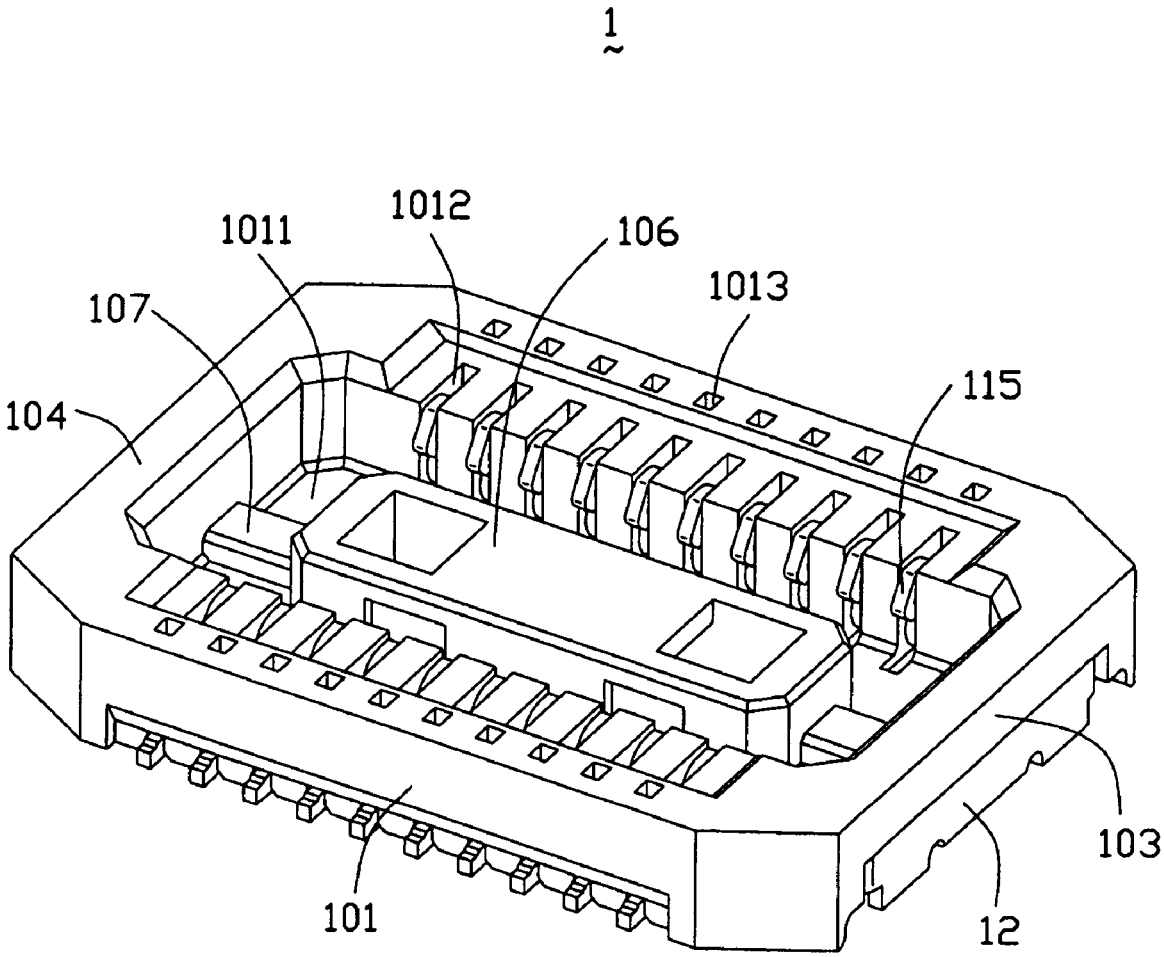
FIG. 3 is an assembled perspective view of a female connector as shown in FIG. 2.
Figure 4:
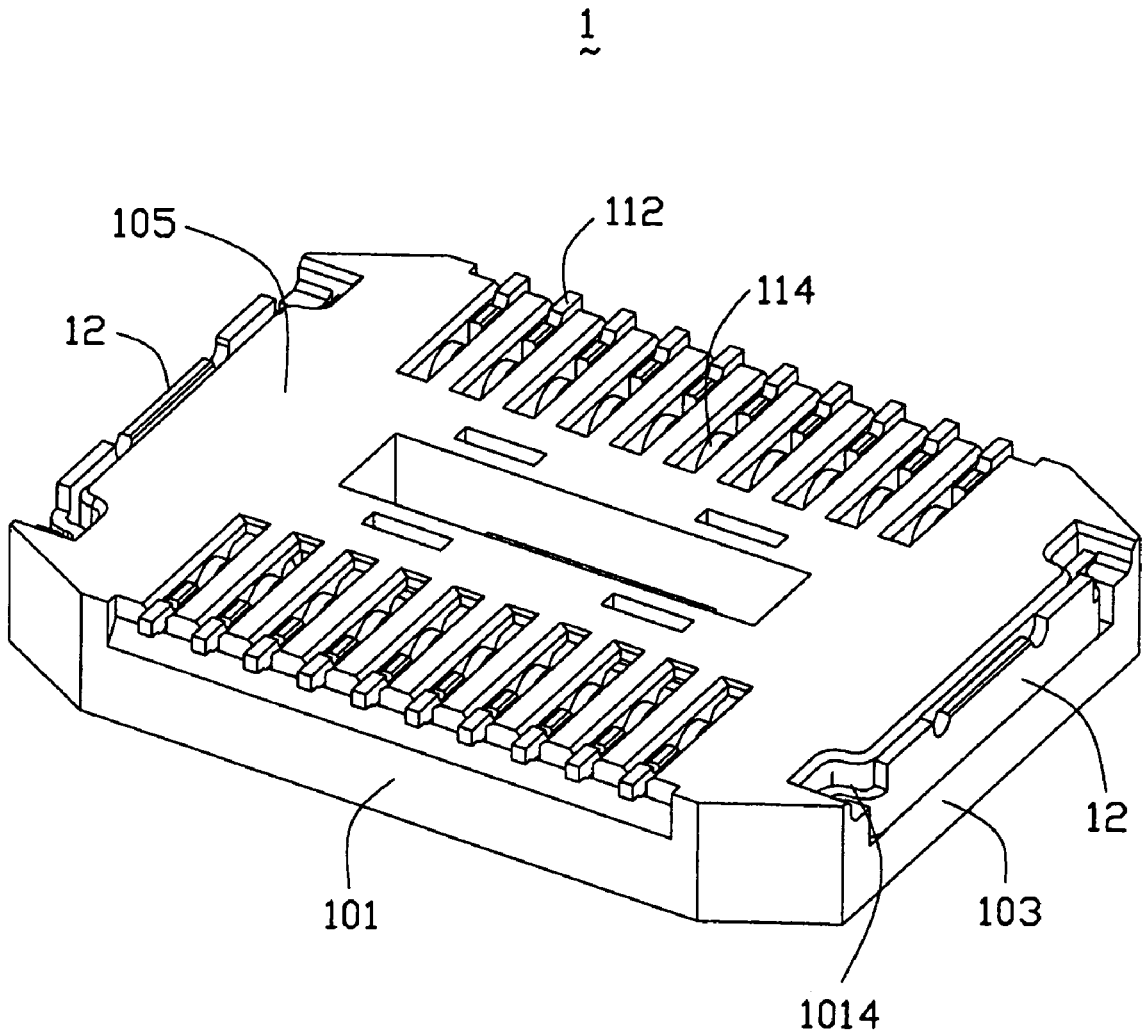
FIG. 4 is an assembled perspective view of the female connector of FIG. 3 taken from another aspect.

Referring to FIGS. 2-4, the first insulator 10 is a substantially rectangular case, comprising a bottom wall 105, a pair of primary walls 101 and a pair of periphery walls 103 extending upwardly from the bottom wall 105 to thereby define a retaining space 1011 thereamong. The first insulator 10 is provided with a rectangular central portion 106 surrounded by the walls 101, 103, and a pair of protrusions 107 symmetrically positioned on opposite sides of the central portion 106. The central portion 106 has two pairs of indentations 1061 defined at another pair of opposite sides thereof.

Referring to FIGS. 2-4 and 8, each primary wall 101 has a plurality of grooves 1012 communicating with the retaining space 1011 defined at regular intervals lengthwise along an inner surface thereof and a plurality of slots 1013 preferably aligned with the grooves 1012 defined therein. The grooves 1012 and the slots 1013 preferably communicating with each other extend in a top-to-bottom direction throughout the primary walls 101 and the bottom wall 105. A recesses 1014 is defined at a lower portion of each periphery wall 103, with a pair of free ends thereof extending laterally toward the bottom wall 105.

Figure 5:
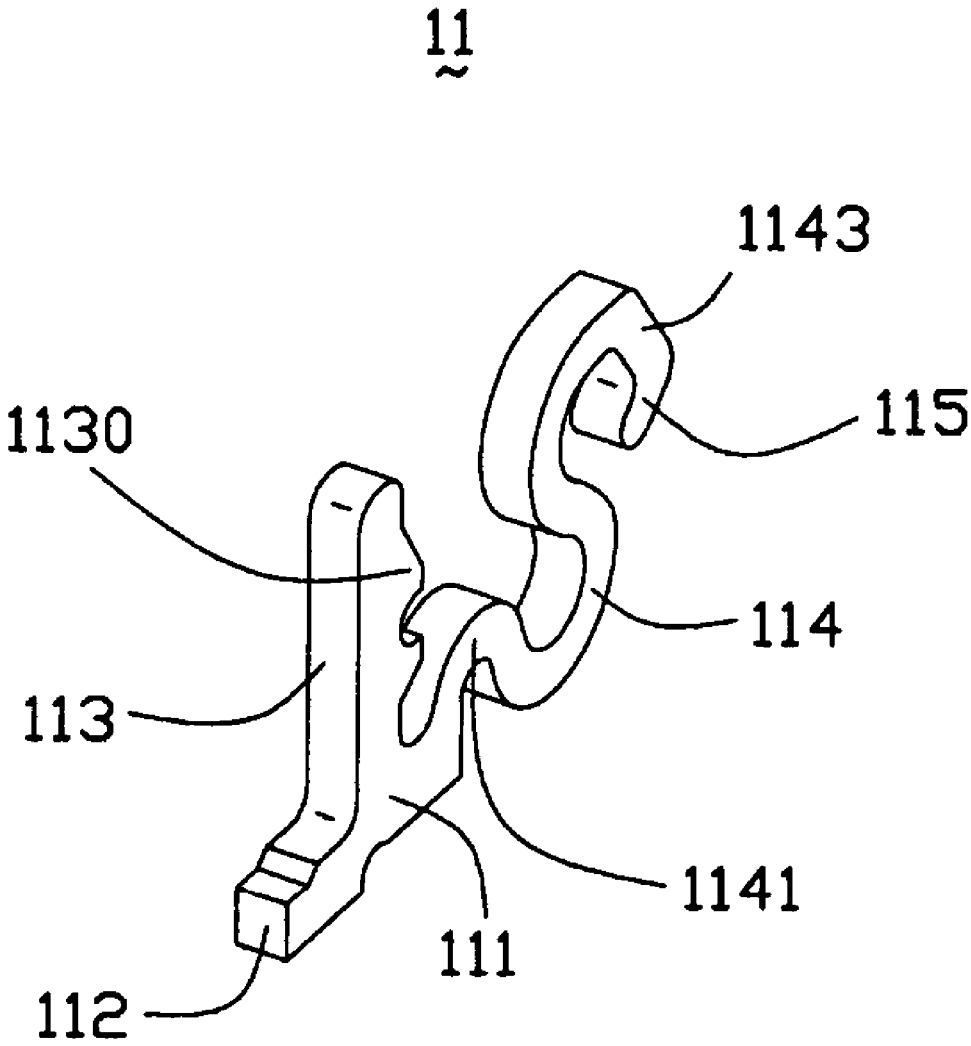
FIG. 5 is a perspective view of a female terminal.

Referring to FIG. 5, each female terminal 11 comprises a horizontal body portion 111, a retaining portion 113 raising upwardly from a substantially middle portion of the body portion 111, a resilient contact section 114 projecting laterally from an end of the body portion 111, a contacting end 115 formed at a free end of the resilient contact section 114 for contacting with the male connector 2, and a foot 112 extending generally horizontally from the other end of the body portion 111. Each retaining portion 113 has a plurality of barb portions 1130 formed along an inner surface thereof. The resilient contact section 114 is formed with three continuous compressible arc-like portions 1141. The resilient contact section 114 additionally has an obliquely extending guiding face 1143 formed besides the contacting end 115 for easing insertion of the male connector 2 into the female connector 1.

Referring to FIGS. 2-4, in assembly of the female connector 1, the female terminals 11 are fixed to the primary walls 101 by insert molding, with the body portions 111 thereof disposed within the corresponding grooves 1012, the resilient contact sections 114 thereof retained in the grooves 1012, the contacting ends 115 thereof projecting inwardly toward the retaining space 1011 and the feet 112 thereof extending outwardly through grooves 1012 for surface mounting onto the first PCB. The inserting portions 113 of female terminals 11 are fixed in the corresponding slots 1013, with the barb portions 1130 thereof frictionally having an interference with an inner surface of the slots 1013 for firmly fixing the female terminal 11 to the first insulator 10. The pair of first mounting portions 12 having same shapes and dimensions are inserted into the corresponding mounting recesses 1014 for soldering onto the first PCB.

Figure 6:
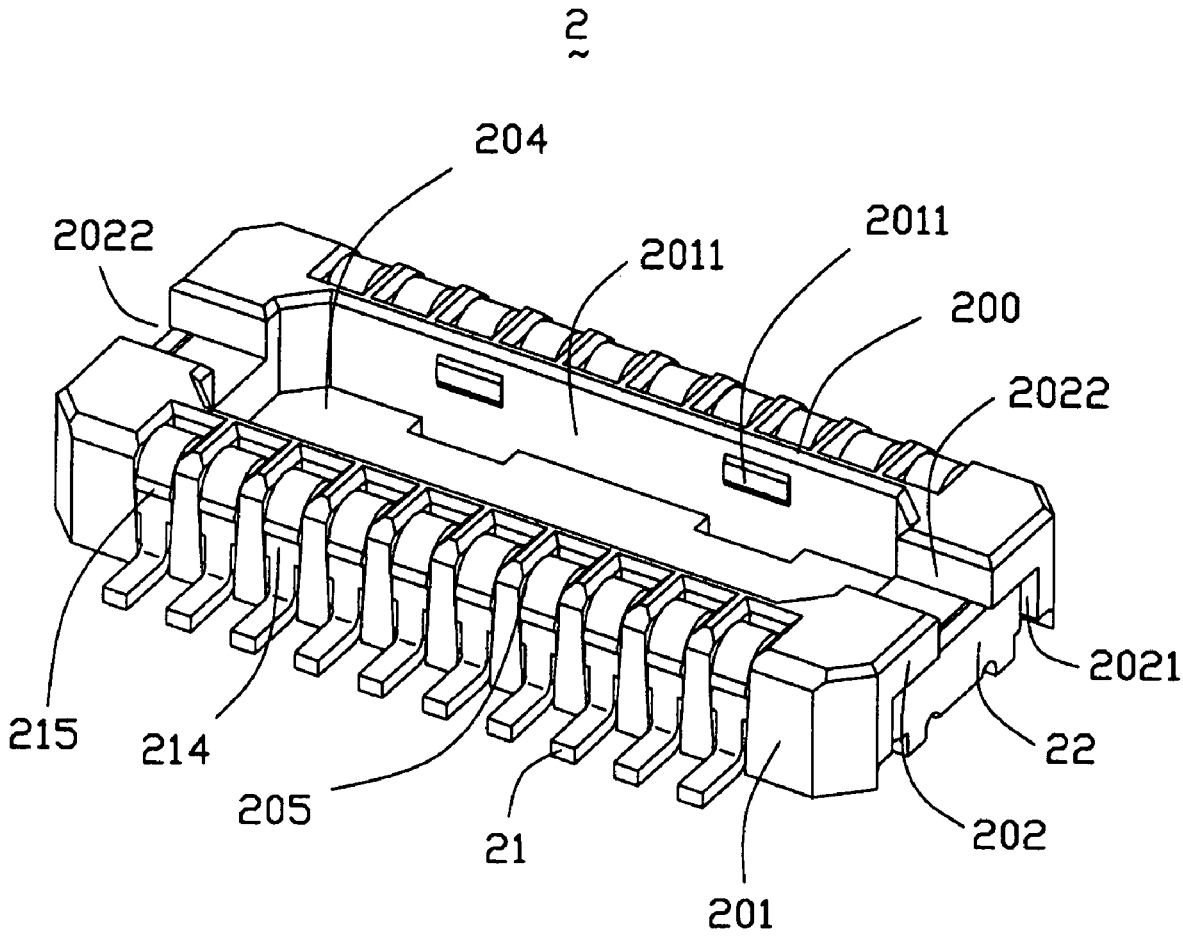
FIG. 6 is an assembled perspective view of a male connector as shown in FIG. 2.
Figure 7:
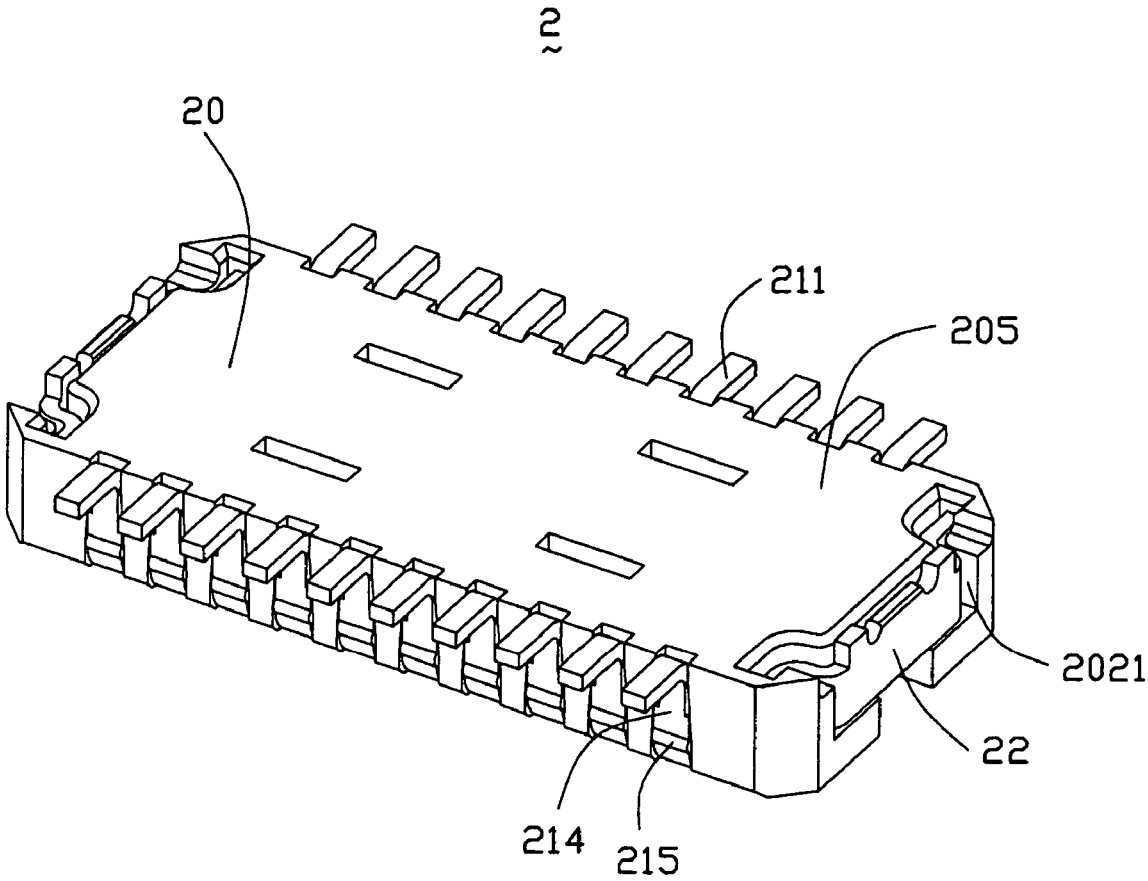
FIG. 7 is an assembled perspective view of a male connector of FIG. 6 taken from another aspect.
Figure 8:
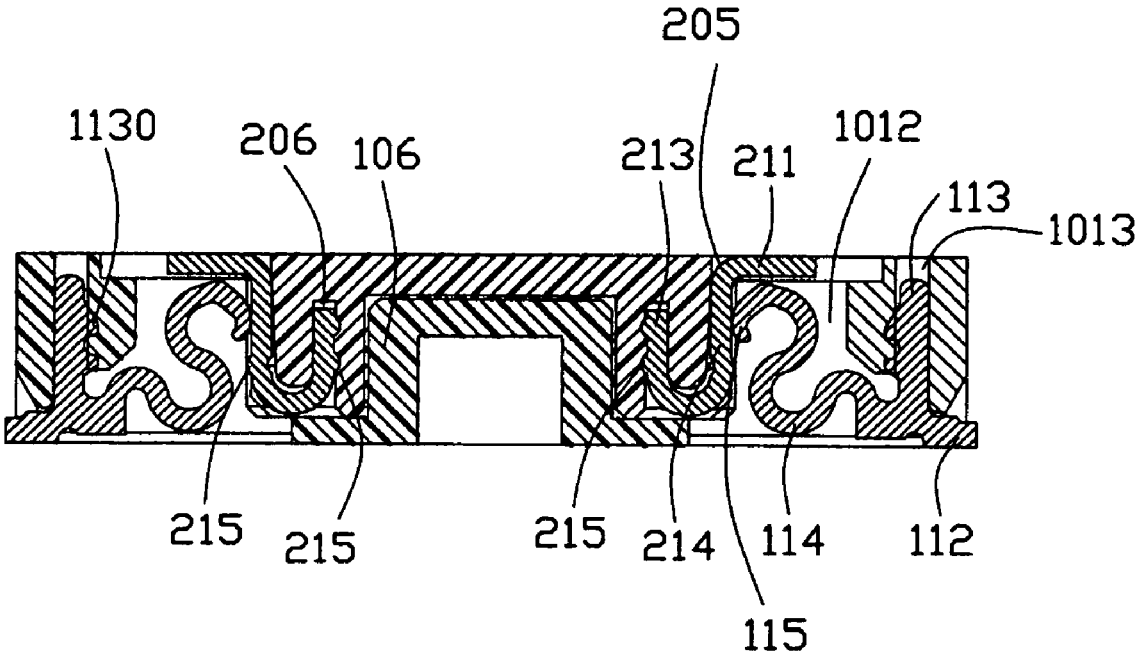
FIG. 8 is a cross-sectional view of the electrical connector as shown in FIG. 1 taken along line 8-8.

Referring to FIGS. 2, 6 and 7, the male connector 2 consists of a second insulator 20, two rows of male terminals 21 longitudinal arranged in the second insulator 20 at regular interval and a pair of second mounting portions 22 attached to the second insulator 20.

The second insulator 20 is a substantially rectangular case, comprising a base 203, a plurality of raising walls 200 raising upwardly from the base 203 and enclosing therearound to thereby define an elongated cavity 204 therein. The raising walls 200 have a pair of opposite primary walls 201 and a pair of combined walls 202 interconnecting an opposite edge of each primary wall 201. Each primary wall 201 has a plurality of channels 205 and a plurality of slits 206 communicating with the channels 205 defined at regular intervals along a length thereof. Each primary wall 201 has a pair of tubers 2011 formed at an inner surface thereof for engaging with the indentations 1061 of the female connector 1.

Each combined wall 202 has a cutout 2022 defined at a centre of a top face thereof for engaging with the protrusion 107 of the female connector 1. A mounting recess 2021 is defined at a lower portion of each combined wall 202, with a pair of free ends thereof extending toward the base 203.

Each male terminal 21 comprises a fixing portion 213, an upwardly raising connection portion 214, a tail portion 211 extending laterally from an end of the connection portion 214 and an U-shaped bending portion 212 connecting the fixing portion 213 and the connection portion 214 together. The fixing portion 213 has a plurality of click protrusions 215 formed thereon for having an interference with an inner surface of the slit 206. The connection portion 214 is provided with a click protrusion 215.

In assembly of the male connector 2, the male terminals 21 are inserted in the second insulator 20 by insert molding, with the connection portions 214 thereof disposed within the corresponding channels 205, the tail portions 211 thereof exposed outside the second insulator 20 for surface mounting onto the second PCB, the fixing portions 213 thereof inserted into the slits 206 and the click protrusions 215 thereof frictionally engaging with an inner surface of the slits 206 for firmly fixing the male terminals 21 to the second insulator 20. The pair of second mounting portions 22 having a dimension smaller than that of the first mounting portions 12 are retained in the mounting 2021 for soldering onto the second PCB.

Referring to FIGS. 1-8, when the male connector 2 is guided into the retaining space 1011 of female connector 1, the resilient contact sections 114 of the female connector 11 are depressed backwardly and the guiding faces 1143 thereof would perform a lead-in function to guide the male connector 2 into engagement with the female connector 1. The click protrusions 215 formed on the extending portions 214 slide downwardly along the guiding faces 1143 and across the contacting ends 115. When the female connector 1 and the male connector 2 are mated together, the second insulator 20 is completely inserted into the retaining space 1011, with the cavity 204 thereof retaining the central portion 106, the cutout 2022 thereof engaging with the protrusions 107 and the tubers 2011 thereof plunged into the indentations 1061 for resisting accidental unmating of the male connector 2 from the female connector 1. Meanwhile, the contacting ends 115 of the female terminal 11 contact with the connection portions 214 of the male terminal 21 for electrically connection to the male terminal 21. The feet 112 of the female terminals 11 and the first mounting portions 12 are electrically connect the first PCB, the tail portions 211 of the male terminals 21 and the second mounting portions 22 are electrically connect the second PCB. Therefore, an electrical connection between the first and second PCBs is established due to an engagement of the female terminals 11 and the male terminals 21.

Each resilient contact section 114 adapted for being depressed backwardly is configured as three continuous compressible arc-like portions 1141. The resilient contact section 114 having such a configuration is able to provide a resilient force and a mechanical retention force stronger than the force provided by an S-shaped configuration or an U-shaped configuration. Therefore, the female terminals 11 are greatly strengthened to have a better mechanical performance and thus are capable of being securely depressed for certain a long time.

Additionally, due to the insertion of the fixing portions 213 into the slits 206 and the interference engagement between the click protrusions 215 and the slits 206, the connection portions 214 of the male terminals 21 are firmly fixed to the second insulator 20 for stably contacting with the contacting ends 115 of the female terminals 11.

However, the disclosure is illustrative only, changes may be made in detail, especially in matter of shape, size, and arrangement of parts within the principles of the invention.

What is claimed is:

1. An electrical connector for connecting a first and a second PCBs, comprising:

a female connector electrically connectable to a first PCB, comprising:

a first insulator having a retaining space, a bottom wall and a plurality of upwardly extending side walls, said side walls defining thereon a plurality of grooves communicating with said retaining space;

a plurality of female terminals assembled to said first insulator, each female terminal comprising a resilient contact section disposed in said corresponding groove and provided with at least three compressible portions hanging therein for providing elasticity, with a contacting end formed thereon, and a foot electrically connecting the first PCB;

a male connector electrically connectable to a second PCB, comprising;

a second insulator mated with said first insulator, having a base and a plurality of raising walls, on which a plurality of channels are defined;

a plurality of male terminals mounted on said second insulator, each male terminal having a connection portion disposed within said channel for contacting said contacting end of said female connector and a tail portion electrically connecting the second PCB;

wherein each of the female terminals having a base, an upwardly retaining portion and a solder tail portion extending from one end of the base;

wherein the resilient section extending from an opposite end of the base.

2. The electrical connector as claimed in claim 1, wherein said three compressible portions are configured as three continuous arc-like portions.

3. The electrical connector as claimed in claim 1, wherein the upwardly retaining portion separate from the contact section, the side walls define thereon a plurality of slots preferably aligned with said grooves for insertion of the retaining portions.

4. The electrical connector as claimed in claim 1, wherein said first insulator is provided with a central portion surrounded by the side walls and the second insulator defines therein a cavity for retaining said central portion.

5. The electrical connector as claimed in claim 1, wherein the raising walls of the male connector define thereon a plurality of slits communicating with said channels and wherein each male terminal has a fixing portion fixed in the slit and an U-shaped bending portion connecting the connection portion and the fixing portion together.

6. The electrical connector as claimed in claim 1, wherein said female connector comprises a pair of first mounting portions electrically connecting the first PCB and the first insulator defines thereon a pair of mounting recesses for insertion of the first mounting portions.

7. The electrical connector as claimed in claim 1, wherein said male connector comprises a pair of second mounting portions electrically connecting the second PCB and the second insulator defines thereon a pair of mounting recesses for insertion of the second mounting portions.

8. The electrical connector assembly as claimed in claim 1, wherein a lower portion of said resilient contact section is almost flush with a bottom surface of the first insulator so as to form a low profile connector thereof.

9. The electrical connector as claimed in claim 2, wherein said contacting end projects inwardly toward the retaining space.

10. The electrical connector as claimed in claim 9, wherein each female terminal has a guiding face formed besides said contacting end for easing insertion of said male connector into said female connector.

11. The electrical connector as claimed in claim 3, wherein said retaining portion of each female terminal has a plurality of barb portions formed thereon.

12. The electrical connector as claimed in claim 4, wherein said first insulator is formed with a pair of protrusions symmetrically positioned on opposite sides of the central portion and wherein the second insulator defines a pair of cutouts for engaging with the protrusions.

13. The electrical connector as claimed in claim 4, wherein said central portion defines thereon a plurality of indentations and the raising walls has a plurality of tubers engaging with the indentations.

14. An electrical connector assembly comprising:

a first connector including:

a first insulative housing defining at least one row of first passageways therein;

a plurality of first terminals including a base joined with an S-shaped contact section, a retention section upwardly extending from the base; and a second connector including;

a second insulative housing defining a plurality of second passageways, respectively;

a plurality of second terminals disposed in the corresponding second passageways, respectively;

wherein the lower portion of said S-shaped contact section is almost flush with an exterior bottom surface of the first housing so as to form a low profile connector thereof;

wherein the S-shaped contact section comprising at least three compressible portions hanging in the first passageway;

wherein the upwardly retaining section and a solder tail portion extending from one end of the base;

wherein the S-shaped contact section extending from an opposite end of the base.

15. The electrical connector assembly as claimed in claim 14, wherein said S-shaped contact section is slightly tilted toward the corresponding second terminals.

16. The electrical connector assembly as claimed in claim 15, wherein said S-shaped contact section is joined with the base via a downward curved section.

17. The electrical connector assembly as claimed in claim 14, wherein the first passageways are open to an exterior through said bottom surface of the first housing.

18. An electrical connector assembly comprising:

a first connector including:

a first insulative housing defining at least one row of first passageways therein;

a plurality of first terminals disposed in the corresponding first passageways, respectively;

each of said first terminals including a base joined with a curved contact section, a retention section upwardly extending from the base; and a second connector including:

a second insulative housing defining a plurality of second passageways, respectively;

a plurality of second terminals disposed in the corresponding second passageways, respectively;

each of said second terminals including an upside-down U-shaped contact section, each second terminal comprising a horizontal mounting section extending from a distal end of an outer leg of the contact section; wherein an inner leg of said U-shaped contact section provides a retention function and an outer leg of said U-shaped contact section engages the corresponding curved contact section of the first terminal;

wherein the curved contact section not only downwardly directly communicates with an exterior but also upwardly directly faces a horizontal mounting section which extends from an outer leg of said U-shaped contact section;

wherein the curved contact section comprising at least three compressible portions hanging in the first passageway;

wherein the upwardly retaining section and a solder tail portion extending from one end of the base;

wherein the curved contact section extending from an opposite end of the base.

19. The electrical connector assembly as claimed in claim 18, wherein said curved contact section includes at least essentially an S-configuration.

20. The electrical connector assembly as claimed in claim 18, wherein the said curved contact section includes at least three arc-like effective compressible portions for mating with the second connector.

* * * * *